United States Patent [19]

Widmer

[11] 3,958,405

[45] May 25, 1976

[54] TEXTILE SPINDLE

[75] Inventor: Dieter Widmer, Uster, Switzerland

[73] Assignee: Spindle-Motoren-und Maschinenfabrik A.G., Uster, Switzerland

[22] Filed: Mar. 6, 1975

[21] Appl. No.: 555,769

Related U.S. Application Data

[63] Continuation of Ser. No. 374,155, June 27, 1973, abandoned.

[30] Foreign Application Priority Data

July 10, 1972 Switzerland ..... 10291/72

[52] U.S. Cl. ..... 57/135

[51] Int. Cl.[2] ..... D01H 7/12

[58] Field of Search ..... 57/134–135; 308/152, 228; 64/1 V

[56] References Cited

UNITED STATES PATENTS

| | | | |
|---|---|---|---|
| 375,709 | 12/1887 | Logan | 57/135 X |
| 2,699,033 | 1/1955 | Bell | 57/135 |
| 2,704,946 | 3/1955 | Gray et al. | 57/134 |
| 3,789,598 | 2/1974 | Kieroanski | 57/135 X |
| 3,798,888 | 3/1974 | Mandl | 57/135 |

*Primary Examiner*—Donald O. Woodiel
*Assistant Examiner*—Charles Gorenstein
*Attorney, Agent, or Firm*—Ladas, Parry, Von Gehr, Goldsmith & Deschamps

[57] ABSTRACT

A textile spindle comprising a spindle shaft mounted in an overhung position in a spindle housing by means of two bearings arranged in spaced relationship from one another, the spindle shaft carrying at its free end a whirl and a yarn bobbin. The spindle shaft is supported at the spindle housing between the bearings at the region of its maximum bending- or transverse oscillation deflection via a dampening mechanism.

4 Claims, 2 Drawing Figures

TEXTILE SPINDLE

This is a continuation of application Ser. No. 374,155 filed June 27, 1973, now abandoned.

BACKGROUND OF THE INVENTION

The present invention relates to a new and improved construction of textile spindle comprising a spindle shaft mounted in overhung position in a spindle housing by means of two bearings arranged in spaced relationship from one another, the spindle shaft supporting at its free end a whirl and a yarn bobbin.

Such spindles can be excited into bending- or transverse oscillations by virtue of an irregular, i.e., imbalanced yarn package at the whirl.

According to Canadian Patent 515,112 which teaches a state-of-the-art textile spindle of this type there is proposed, for the purpose of reducing the oscillations, rigidly constructing the spindle shaft at its free end carrying the whirl and flexibly constructing the spindle blade or center shaft mounted therein, so that the spindle shaft can bend-through under the action of the oscillations and together therewith the end carrying the whirl can rotate about an axis inclined with respect to the main axis of the spindle. With this prior art textile spindle the axis of the whirl which is subject to imbalance, in the event of imbalance of the whirl, does not remain spatially fixed, rather describes a cone. By virtue of this construction oscillations brought about by imbalance are intended to be prevented or at least reduced as concerns their damaging effects. However, the conical rotation of the whirl disturbs the uniform winding-up and winding-off of a yarn onto and from the yarn bobbin.

SUMMARY OF THE INVENTION

Hence, it is a primary object of the present invention to provide an improved construction of textile spindle which is not associated with the aforementioned drawbacks and limitations of the prior art proposals.

Another and more specific object of the present invention aims at the provision of a textile spindle of the previously mentioned type which is constructed such that oscillations, and particularly transverse or lateral oscillations of the textile spindle, are effectively suppressed even if the spindle shaft possesses a slim construction, i.e., with compact constructions of the spindle shaft.

Now in order to implement these and still further objects of the invention, which will become more readily apparent as the description proceeds, the invention contemplates that the spindle shaft is supported by means of a dampening mechanism at the spindle housing between the bearings at the region of its maximum bending-or transverse oscillation deflection.

According to a preferred constructional manifestation the dampening mechanism comprises a spring which is flexible in radial direction and which, for instance, can be loosely introduced into the spindle housing and constructed as an axially retaining spiral spring.

BRIEF DESCRIPTION OF THE DRAWINGS

The invention will be better understood and objects other than those set forth above, will become apparent when consideration is given to the following detailed description thereof. Such description makes reference to the annexed drawings wherein FIG. 1 schematically illustrates in axial sectional view an embodiment of textile spindle constructed according to the teachings of the invention and wherein.

DETAILED DESCRIPTION OF THE PREFERRED EMBODIMENTS

Figure 1:
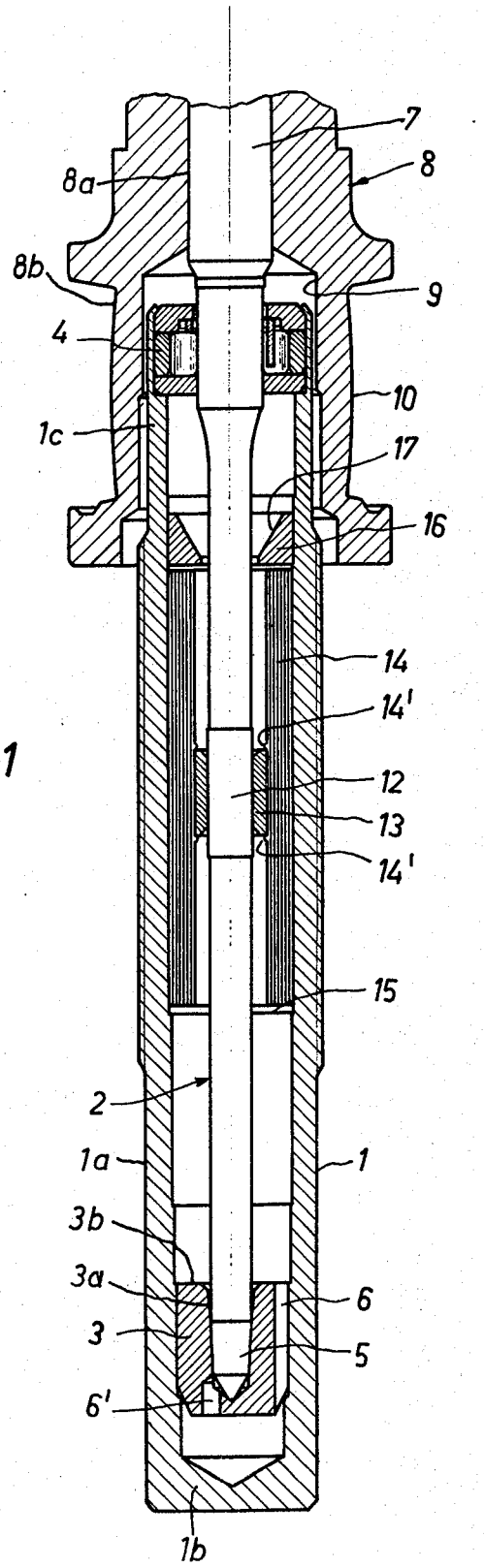

Describing now the drawings the exemplary illustrated embodiments of textile spindle constructed according to the invention will be understood to comprise a spindle housing 1 in the form of an elongate or lengthwise extended sleeve 1a which is closed at the bottom **1*b* and open at the top 1*c*. In this sleeve 1a there is mounted a spindle shaft 2 by means of a footstep or vertical bearing 3 and a roller bearing 4. The footstep bearing 3 possesses a weakly tapered or conical blindhole bore 3*a* which is open towards the top 3*b* and serves to receive the appropriately conically bevelled or tapered lower tip 5 of the spindle shaft 2 and an outer oil channel 6 as well as an inner oil bore 6 which intersects with the blindhole bore 3*a***.

The enlarged diameter or reinforced free end 7 of the spindle shaft 2 is seated by means of a snug fit in a bore **8*a* of a whirl 8. This whirl 8 has a downwardly extended region or portion 8*b* which is internally provided with a recess or opening 9 for receiving the upper open end 1*c* of the spindle housing 1 and at the outside is provided with a wide peripheral recess or depression 10 for guiding the non-illustrated drive band or the like. This construction is compact and ensures that oil which may possibly depart from the open end of the spindle housing 1 will flow-off at the inner wall of the recess 9** and will not contaminate or otherwise soil the non-illustrated yarn windings or package.

The spindle shaft 2 is provided with a bearing collar 12 approximately at its central region at the zone of maximum transverse oscillation deflection, that is to say, at the apex of the transverse or lateral oscillation and which for instance can be generated by an imbalance or eccentricity of the yarn winding or package at the whirl 8. The bearing collar 12 is supported via a guide sleeve or bushing 13 at a dampening element, here in the form of a spiral spring 14. This spiral spring 14 possesses projections 14' between which there is axially retained the guide sleeve or bushing 13. The spiral spring 14 is loosely inserted into the spindle housing 1 and bears against a shoulder 15 provided therein and is prevented from departing upwardly therefrom by a centering ring 16 or the like. This centering ring 16 possesses an upwardly open funnel-shaped centering opening 17 facilitating the introduction of the spindle shaft 2.

By virtue of the fact that the dampening element 14 is arranged at the apex of the possibly occurring transverse or lateral oscillations of the textile spindle there is ensured for an effective dampening of such oscillations or vibratins.

Dampening of the spindle shaft occurs, as mentioned, via the dampening element 14 which, if desired, can be located in an oil bath.

Figure 2:
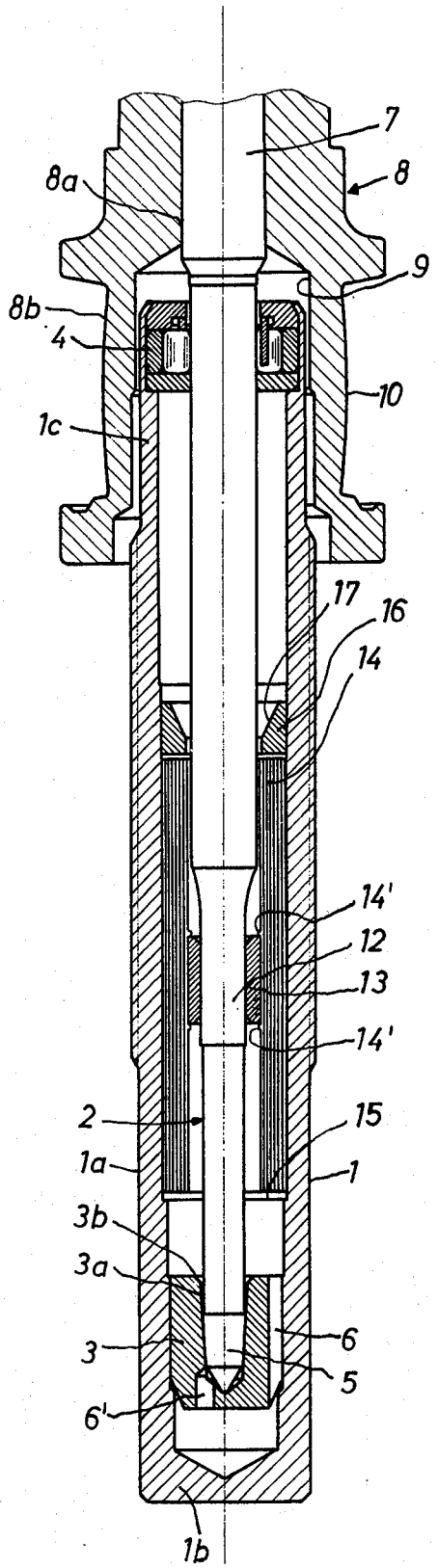
FIG. 2 shows in axial sectional view a slightly modified embodiment.

FIG. 2 of the drawing shows an embodiment similar to that of FIG. 1 with the difference that the diameter of the spindle shaft 2 is greater between the roller bearing 4 and the guide sleeve 13 than between the guide sleeve 13 and the footstep bearing 3. Due to this construction the rigidity of the spindle shaft 2 above the guide sleeve 13 will be greater than below the guide sleeve 13 and allows a still increased dampening of the transverse oscillations.

While there is shown and described present preferred embodiments of the invention, it is to be distinctly understood that the invention is not limited thereto, but may be otherwise variously embodied and practiced within the scope of the following claims.

Accordingly, what is claimed is:

1. A textile spindle comprising a spindle housing, a spindle shaft having a free end, two bearings arranged in a space relationship from one another for mounting the spindle shaft in overhung fashion in the spindle housing, a whirl carried by the free end of the spindle shaft, a damping mechanism disposed within the spindle housing between the bearings at the region of maximum bending deflection of the spindle shaft, and means for retaining the damping mechanism against axial movement in the spindle housing, the damping mechanism comprising a spiral spring which is flexible in the radial direction with respect to the shaft and which is loosely introduced into the spindle housing and acts directly against the spindle shaft to damp bending deflection of the spindle shaft.

2. The textile spindle as defined in claim 1, further including a guide sleeve arranged between the periphery of the spindle shaft and the spring, said spiral spring having projections, said guide sleeve being axially retained between said projections, said spindle shaft having a bearing collar, said guide sleeve cooperating with said bearing collar for transmitting a radial dampening force from the spiral spring to the spindle shaft.

3. The textile spindle as defined in claim 1, further including a ring member seated in the spindle housing at the side confronting the whirl for axially retaining the dampening mechanism, said ring member possessing a substantially funnel-shaped centering opening for the spindle shaft.

4. The textile spindle as defined in claim 1, further comprising a guide sleeve arranged between the periphery of the spindle shaft and the radially acting spring of the dampening mechanism, and wherein the spindle shaft in its section between the upper one of said bearings and the guide sleeve has a diameter greater than in its section between the guide sleeve and the lower one of said bearings.

* * * * *